US011667497B2

(12) United States Patent
Bhaskar

(10) Patent No.: US 11,667,497 B2
(45) Date of Patent: Jun. 6, 2023

(54) WALL CLIMBING ELEVATOR

(71) Applicant: OTIS ELEVATOR COMPANY, Farmington, CT (US)

(72) Inventor: Kiron Bhaskar, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 17 days.

(21) Appl. No.: 17/088,758

(22) Filed: Nov. 4, 2020

(65) Prior Publication Data

US 2022/0135375 A1 May 5, 2022

(51) Int. Cl.
*B66B 9/02* (2006.01)
*B66B 11/00* (2006.01)

(52) U.S. Cl.
CPC ..... *B66B 9/02* (2013.01); *B66B 11/005* (2013.01); *B66B 11/0005* (2013.01)

(58) Field of Classification Search
CPC ..... B66B 9/02; B66B 11/005; B66B 11/0005; B66B 11/0025; B66B 17/06; B66B 9/193; B66B 9/10; B66B 1/40
See application file for complete search history.

(56) References Cited

U.S. PATENT DOCUMENTS 2,052,690 A * 9/1936 Austin ..... B66B 11/005 187/250
5,464,072 A * 11/1995 Muller ..... B66B 9/02 182/12
5,501,295 A * 3/1996 Muller ..... B66B 9/02 187/406
5,566,784 A * 10/1996 Rennetaud ..... B66B 9/02 187/257
5,713,432 A * 2/1998 Richter ..... B66B 11/0206 187/250
6,098,758 A * 8/2000 Gates ..... B66B 9/02 187/250
8,997,405 B2 * 4/2015 Geyer ..... E04F 17/005 52/843
2003/0217893 A1 * 11/2003 Dunser ..... B66B 9/02 187/249

FOREIGN PATENT DOCUMENTS

WO WO-2021081465 A1 * 4/2021
WO WO-2021180510 A1 * 9/2021

* cited by examiner

*Primary Examiner* — Michael R Mansen
*Assistant Examiner* — Michelle M Lantrip
(74) *Attorney, Agent, or Firm* — Carlson, Gaskey & Olds, P.C.

(57) ABSTRACT

An illustrative example embodiment of an elevator includes an elevator car and a drive mechanism connected with the elevator car. The drive mechanism moves with the elevator car in a vertical direction. The drive mechanism includes drive members that are configured to engage surfaces associated with walls near opposite sides of the elevator car, climb along the surfaces to selectively cause movement of the elevator car, and selectively prevent movement of the elevator car when the drive members remain in a selected position relative to the wall.

16 Claims, 3 Drawing Sheets

WALL CLIMBING ELEVATOR

BACKGROUND

Elevator systems have proven useful for carrying passengers among various levels within a building. There are various types of elevator systems. For example, some elevator systems are considered hydraulic and include a piston or cylinder that expands or contracts to cause movement of the elevator car. Other elevator systems rely on suspending ropes or belts between the elevator car and a counterweight. A machine includes a traction sheave that causes movement of the ropes or belts to achieve the desired movement and positioning of the elevator car. Hydraulic systems are generally considered useful in buildings that have a few stories while roped systems are typically used in taller buildings.

Each of the known types of elevator systems has features that present challenges for some implementations. For example, although roped elevator systems are useful in taller buildings, in ultra-high rise installations the ropes or belts are so long that they introduce appreciable mass and expense. The added mass of long ropes requires more power and that results in added power consumption cost. Sag due to stretch and bounce of the elevator car are other issues associated with longer ropes or belts. Additionally, longer ropes or belts and taller buildings are more susceptible to sway and drift, each of which requires additional equipment or modification to the elevator system. For such reasons, alternative elevator configurations could be useful.

SUMMARY

An illustrative example embodiment of an elevator includes an elevator car and a drive mechanism connected with the elevator car. The drive mechanism moves with the elevator car in a vertical direction. The drive mechanism includes drive members that are configured to engage surfaces on walls near opposite sides of the elevator car, climb along the surfaces to selectively cause movement of the elevator car, and selectively prevent movement of the elevator car when the drive members remain in a selected position relative to the wall.

In addition to one or more of the features described above, or as an alternative, the drive members each comprise a wheel that is configured to selectively roll along one of the surfaces.

In addition to one or more of the features described above, or as an alternative, each drive member is biased in a direction away from a center of the elevator car toward one of the surfaces.

In addition to one or more of the features described above, or as an alternative, the drive members are biased in the direction with an aggregate force that is sufficient for engagement between the drive members and the surfaces to support a load of the elevator car.

In addition to one or more of the features described above, or as an alternative, the elevator includes a controller that controls movement of the drive members, the controller being configured to adjust one of a torque or speed of rotation of at least one of the drive members to adjust a tilt of the elevator car.

An illustrative example embodiment of an elevator system includes a hoistway including a plurality of walls. The guiding surfaces on at least two of the walls face in opposite directions. An elevator car is situated within the hoistway. A drive mechanism is connected with the elevator car. The drive mechanism moves with the elevator car along the hoistway. The drive mechanism includes drive members that engage the guiding surfaces, climb along the guiding surfaces to selectively cause movement of the elevator car, and selectively prevent movement of the elevator car when the drive members remain in a selected position relative to the walls.

In addition to one or more of the features described above, or as an alternative, the elevator system includes load bearing structures within the walls in positions where the load bearing structures carry a load associated with engagement between the drive members and the guiding surfaces.

In addition to one or more of the features described above, or as an alternative, the load bearing structures each comprise a column.

In addition to one or more of the features described above, or as an alternative, the walls comprise a first material and each column comprises a second material that is different than the first material.

In addition to one or more of the features described above, or as an alternative, each column comprises metal.

In addition to one or more of the features described above, or as an alternative, each column comprises reinforced concrete.

In addition to one or more of the features described above, or as an alternative, the guiding surfaces each have a contour, the drive members each have a complementary contour, and the contours of the guiding surfaces and the drive members center the drive members on the guiding surfaces.

In addition to one or more of the features described above, or as an alternative, the guiding surfaces each comprise a vertically oriented groove in a respective one of the walls, the contour of the guiding surfaces is concave, and the complementary contour of the drive members is convex.

In addition to one or more of the features described above, or as an alternative, the guiding surfaces each comprise a vertically oriented crowned surface on a respective one of the walls facing into the hoistway and, the contour of the guiding surfaces is convex, and the complementary contour of the drive members is concave.

In addition to one or more of the features described above, or as an alternative, the elevator system includes a controller that controls movement of the drive members, the controller being configured to selectively control movement of at least one of the drive members to adjust an angular orientation of the elevator car relative to at least one of the hoistway walls.

In addition to one or more of the features described above, or as an alternative, the controller is configured to selectively control movement of the at least one of the drive members by adjusting one of a torque or speed of rotation of the at least one of the drive members.

In addition to one or more of the features described above, or as an alternative, the drive members each comprise a wheel that is configured to selectively roll along one of the guiding surfaces.

In addition to one or more of the features described above, or as an alternative, each drive member is biased in a direction away from a center of the hoistway toward one of the guiding surfaces.

In addition to one or more of the features described above, or as an alternative, the drive members are biased in the direction with an aggregate force that is sufficient for engagement between the drive members and the guiding surfaces to support a load of the elevator car.

The various features and advantages of at least one disclosed example embodiment will become apparent to those skilled in the art from the following detailed description. The drawings that accompany the detailed description can be briefly described as follows.

DETAILED DESCRIPTION

Disclosed example embodiments include an elevator car drive mechanism that is supported for movement with the elevator car. The drive mechanism includes drive members that engage surfaces on hoistway walls that have sufficient structural strength to bear the load associated with engagement with the drive members and supporting the load of the elevator car. Disclosed example embodiments and others provide an efficient use of hoistway space.

Figure 1:
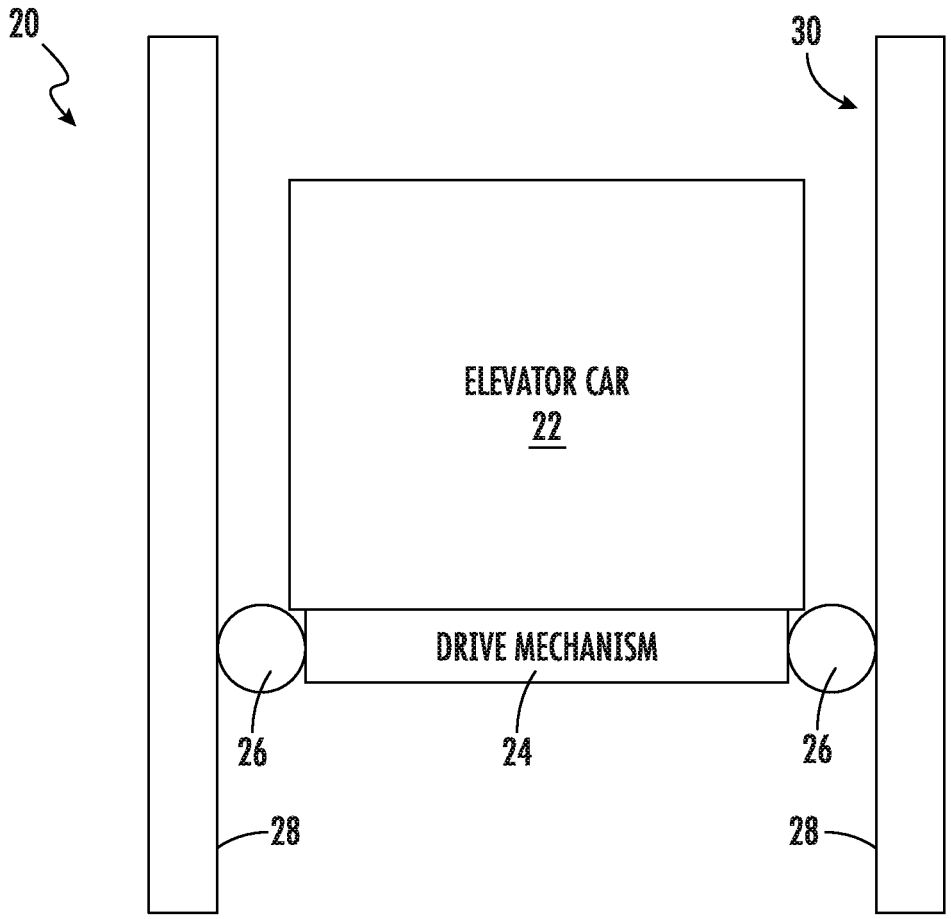
FIG. 1 schematically illustrates selected portions of an example embodiment of an elevator system.

FIG. 1 schematically illustrates selected portions of an example embodiment of an elevator system 20. An elevator car 22 has a drive mechanism 24 that is connected with the elevator car 22 and moves with the elevator car 22 in a vertical direction. The drive mechanism 24 includes drive members 26 that engage guiding surfaces 28 on oppositely facing walls of a hoistway 30.

In this example, the drive members 26 comprise wheels that are rotatable. The drive mechanism 24 causes the drive members 26 to rotate while engaging the guiding surfaces 28 to move the elevator car 22 in a vertical direction within the hoistway 30. The drive mechanism 24 causes the drive members 26 to remain stationary relative to the guiding surfaces 28 while engaging the guiding surfaces 28 to maintain a stationary position of the elevator car 22 while supporting the load of the elevator car 22.

Figure 2:
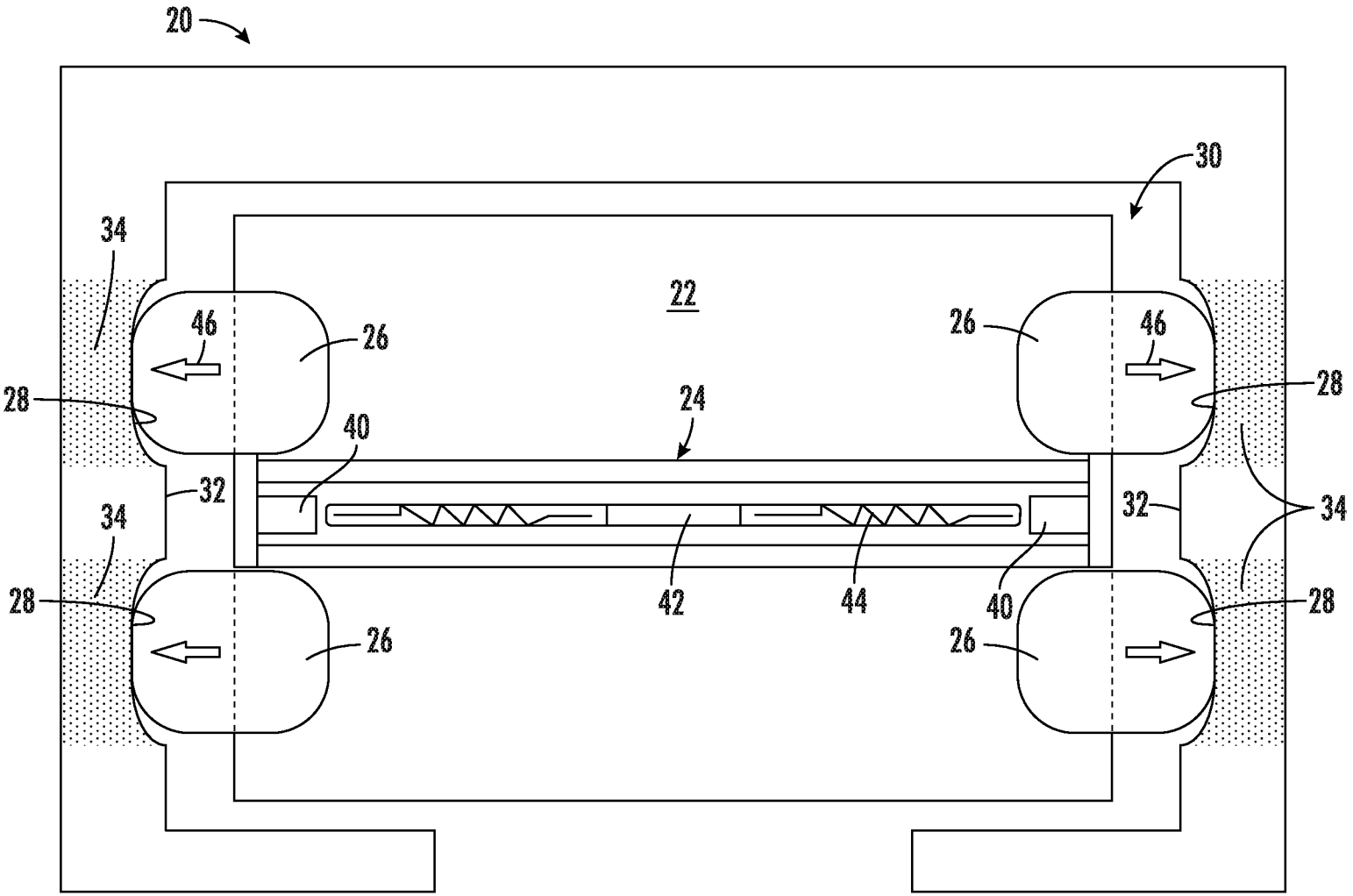
FIG. 2 schematically illustrates selected features of the embodiment of FIG. 1 viewed from underneath the elevator car.

FIG. 2 schematically shows an example arrangement of a drive mechanism 24 and guiding surfaces 28 as seen from beneath the elevator car 22. In this example, the guiding surfaces 28 comprise recesses or grooves in oppositely facing walls 32 of the hoistway 30.

The hoistway walls 32 include reinforced portions 34 near the guiding surfaces 28 to provide sufficient structural stability and strength to bear the loads associated with the drive members 26 engaging the guiding surfaces 28.

The reinforced portions 34 include a material that is different than a remainder of the hoistway walls 32. For example, the hoistway walls 32 primarily comprise a first material and the reinforced portions comprise a second, different material. In some embodiments, the hoistway walls 32 comprise concrete and the reinforced portions 34 comprise a reinforced concrete having a different composition or density, for example. In some embodiments, the reinforced portions 34 comprise metal, such as steel. The reinforced portions 34 may be formed as part of the hoistway walls 32 during construction of those walls or the reinforced portions 34 may be formed separately from the walls 32 and installed into the walls 32 during construction of the hoistway 30, for example.

The drive mechanism 24 in this example includes motors 40 to cause rotation of the drive members 26. A controller 42 controls operation of the motors 40. A biasing mechanism 44 biases or urges the drive members 26 in an outward direction away from a center of the elevator car 22 as schematically represented by the arrows 46. The reinforced portions 34 of the walls 32 bear the loads associated with the force causing engagement between the drive members 26 and the guiding surfaces 28 and supporting the load of the elevator car 22.

The drive members 26 have a contour that is complementary to a contour of the guiding surfaces 28. The guiding surfaces 28 in this example have a contour that is concave. In this example, the drive members 26 have a convex contour corresponding to the concave contour of the guiding surfaces 28. The complementary contours of the guiding surfaces 28 and the drive members 26 facilitate centering or tracking movement of the drive members 26 along the guide surfaces 28. The complementary contours facilitate moving the elevator car 22 along a desired path established by the guiding surfaces 28 within the hoistway 30. The position of the drive members 26 on the guiding surfaces 28 also serves to control proper positioning of the elevator car 22 relative to landings, for example, along the hoistway 30.

The controller 42 monitors position and movement of the elevator car 22. The controller 42 obtains information from sensors associated with the elevator car 22 to determine a tilt or level condition of the elevator car 22. If the elevator car 22 were tilted toward the right or left according to the drawing, the controller 42 selectively adjusts movement of at least one of the drive members 26 to adjust the level of the elevator car 22. If such tilt occurs when the elevator car is stationary, the controller 42 may cause a selected number of the drive members 26 to rotate to achieve a desired car orientation. If tilt occurs during movement of the elevator car 22, the controller 42 may adjust the torque or speed of rotation of a selected number of the drive members 26 to achieve the desired car orientation.

Figure 3:
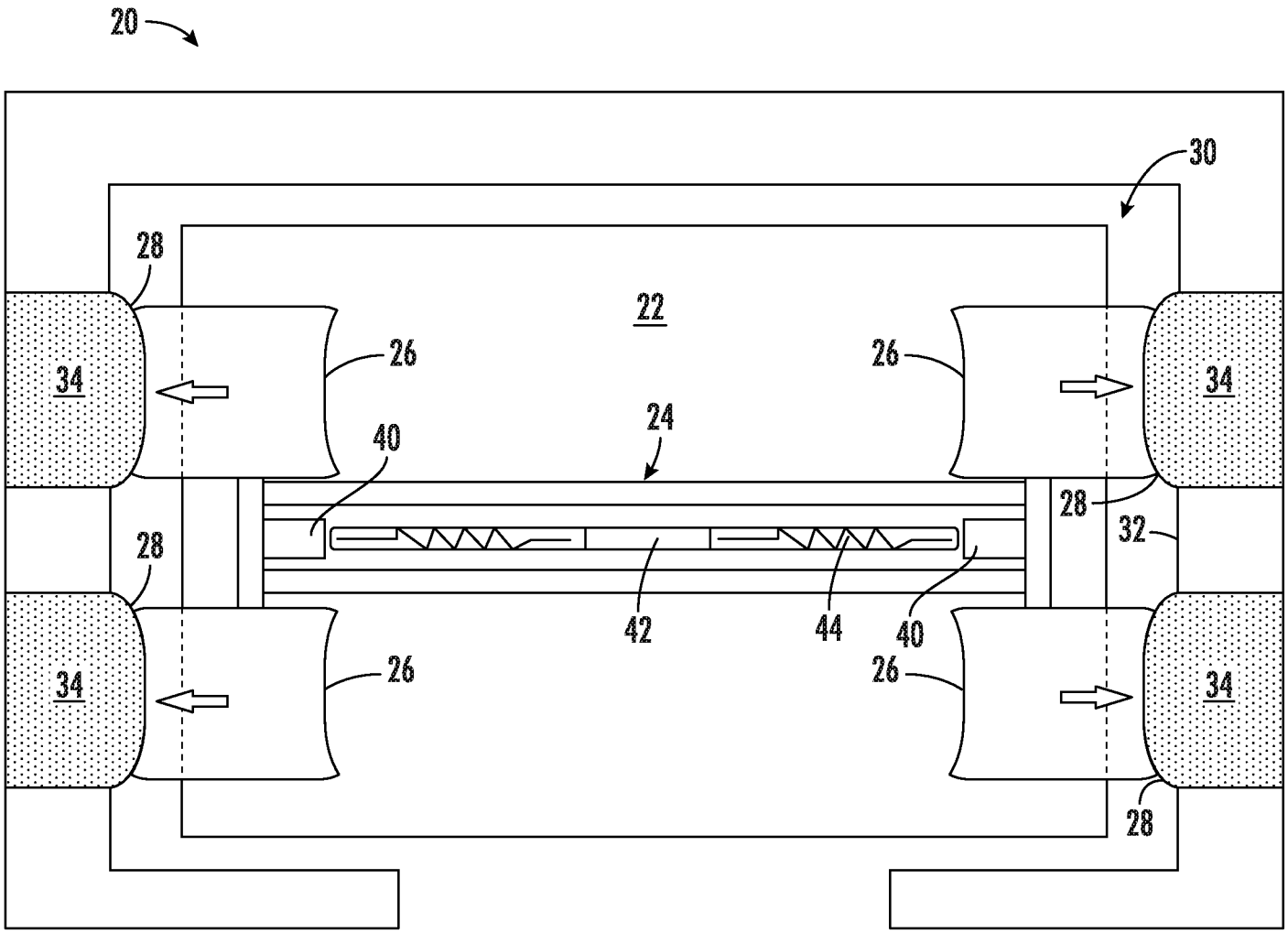
FIG. 3 schematically illustrates selected features of another example embodiment viewed from underneath the elevator car.

FIG. 3 schematically illustrates another example embodiment. In this example, the guiding surfaces 28 comprise ribs or ridges along the hoistway walls 32 on opposite sides of the elevator car 22. The contour of the guiding surfaces 28 in this example is convex. The drive members 26 in this example embodiment include an at least partially concave contour that is complementary to the convex contour of the guiding surfaces 28. The complementary contours facilitate tracking or centering the drive members 26 along the guiding surfaces 28.

Some example embodiments include a supplementary rail (not illustrated) within the hoistway 30. Such a rail may be used to facilitate guiding the vertical movement of the elevator car 22, provide a surface to be engaged by known types of elevator safety brakes, or both. With guiding surfaces 28 and drive members 26 like those in the illustrated example embodiments, a separate guiderail may not be necessary.

One of the features of the disclosed example embodiments is an efficient use of hoistway space. With guiding surfaces 28 on walls of the hoistway 30, separate guiderails or load bearing structures are not necessary within the hoistway 30. It is possible, therefore, to design a hoistway to be relatively smaller and closer in size to the outside envelope of the elevator car 22. This aspect of the disclosed example embodiments facilitates more efficient use of building space and can reduce the cost of an elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator, comprising:

an elevator car;

a drive mechanism connected with the elevator car, the drive mechanism moving with the elevator car in a vertical direction, the drive mechanism including drive members that are configured to engage surfaces on walls near opposite sides of the elevator car, climb along the surfaces to selectively cause movement of the elevator car, and selectively prevent movement of the elevator car when the drive members remain in a selected position relative to the walls; and a controller that controls rotary movement of the drive members, the controller being configured to adjust one of a torque or speed of rotation of at least one of the drive members to adjust a tilt of the elevator car through driven engagement between the at least one of the drive members and the surface on the wall near the at least one of the drive members.

2. The elevator of claim 1, wherein the drive members each comprise a wheel that is configured to selectively roll along one of the surfaces.

3. The elevator of claim 1, wherein each drive member is biased in a direction away from a center of the elevator car toward one of the surfaces.

4. The elevator of claim 3, wherein the drive members are biased in the direction with an aggregate force that is sufficient for engagement between the drive members and the surfaces to support a load of the elevator car.

5. An elevator system, comprising:

a hoistway including a plurality of walls;

guiding surfaces on at least two of the walls that face in opposite directions;

an elevator car situated within the hoistway;

a drive mechanism connected with the elevator car, the drive mechanism moving with the elevator car along the hoistway, the drive mechanism including drive members that engage the guiding surfaces, climb along the guiding surfaces to selectively cause movement of the elevator car, and selectively prevent movement of the elevator car when the drive members remain in a selected position relative to the walls; and a controller that controls movement of the drive members, the controller being configured to selectively control movement of at least one of the drive members to adjust an angular orientation of the elevator car relative to at least one of the hoistway walls, wherein the controller is configured to selectively control rotary movement of the at least one of the drive members to adjust the angular orientation of the elevator car relative to at least one of the hoistway walls through driven engagement between the at least one of the drive members and the guiding surface engaged by the at least one of the drive members, the guiding surfaces each have a curved contour that is one of convex or concave, the drive members each have a complementary curved contour that is the other of convex or concave, and the complementary curved contours of the guiding surfaces and the drive members center the drive members on the guiding surfaces.

6. The elevator system of claim 5, comprising load bearing structures within the walls in positions where the load bearing structures carry a load associated with engagement between the drive members and the guiding surfaces.

7. The elevator system of claim 6, wherein the load bearing structures each comprise a column.

8. The elevator system of claim 7, wherein the walls comprise a first material and each column comprises a second material that is different than the first material.

9. The elevator system of claim 8, wherein each column comprises metal.

10. The elevator system of claim 7, wherein each column comprises reinforced concrete.

11. The elevator system of claim 5, wherein the guiding surfaces each comprise a vertically oriented groove in a respective one of the walls, the curved contour of the guiding surfaces is concave, and the complementary curved contour of the drive members is convex.

12. The elevator system of claim 5, wherein the guiding surfaces each comprise a vertically oriented crowned surface on a respective one of the walls facing into the hoistway and, the curved contour of the guiding surfaces is convex, and the complementary curved contour of the drive members is concave.

13. The elevator system of claim 5, wherein the controller is configured to selectively control movement of the at least one of the drive members by adjusting one of a torque or speed of rotation of the at least one of the drive members.

14. The elevator system of claim 5, wherein the drive members each comprise a wheel that is configured to selectively roll along one of the guiding surfaces.

15. The elevator system of claim 5, wherein each drive member is biased in a direction away from a center of the hoistway toward one of the guiding surfaces.

16. The elevator system of claim 15, wherein the drive members are biased in the direction with an aggregate force that is sufficient for engagement between the drive members and the guiding surfaces to support a load of the elevator car.

* * * * *